US007520100B1

(12) United States Patent
Herrman et al.

(10) Patent No.: US 7,520,100 B1
(45) Date of Patent: Apr. 21, 2009

(54) SUPPORT BACKING FOR WALL STRUCTURE

(75) Inventors: John Herrman, Raleigh, NC (US); Edward diGirolamo, Raleigh, NC (US)

(73) Assignee: The Steel Network, Inc., Raleigh, NC (US)

( * ) Notice: Subject to any disclaimer, the term of this patent is extended or adjusted under 35 U.S.C. 154(b) by 191 days.

(21) Appl. No.: 11/531,902

(22) Filed: Sep. 14, 2006

(51) Int. Cl.

| | |
|---|---|
| ***E04B 1/94*** | (2006.01) |
| ***E04B 9/00*** | (2006.01) |
| ***E04C 2/34*** | (2006.01) |
| ***E04F 13/04*** | (2006.01) |
| ***E04F 19/00*** | (2006.01) |
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |

(52) U.S. Cl. ..... 52/481.1; 52/27; 52/238.1; 52/317; 52/349

(58) Field of Classification Search ..... 52/238.1, 52/243, 317, 349, 481.1, 514, 27, 184, 364, 52/664, 831

See application file for complete search history.

(56) References Cited

U.S. PATENT DOCUMENTS

| | | | | | |
|---|---|---|---|---|---|
| 2,103,064 | A | * | 12/1937 | Clark | 52/696 |
| 3,778,952 | A | * | 12/1973 | Soucy | 52/667 |
| 4,453,362 | A | * | 6/1984 | Rodgers | 52/481.1 |
| 4,485,605 | A | * | 12/1984 | LaLonde | 52/665 |
| 4,658,556 | A | * | 4/1987 | Jenkins | 52/317 |
| 4,791,766 | A | * | 12/1988 | Egri, II | 52/317 |
| 5,189,857 | A | * | 3/1993 | Herren et al. | 52/317 |
| 6,164,028 | A | * | 12/2000 | Hughes | 52/317 |
| 6,253,529 | B1 | * | 7/2001 | De Boer | 52/763 |
| 2005/0050834 | A1 | * | 3/2005 | Elwart | 52/720.1 |

OTHER PUBLICATIONS

"corner." Merriam-Webster Online Dictionary. 2008. Merriam-Webster Online. Jul. 22, 2008 <http://www.merriam-webster.com/dictionary/corner>.*

* cited by examiner

*Primary Examiner*—Brian E. Glessner
*Assistant Examiner*—Branon C Painter
(74) *Attorney, Agent, or Firm*—Coats & Bennett, P.L.L.C.

(57) ABSTRACT

A wall structure is provided and includes a series of spaced apart studs with each stud having a web and a pair of flanges. A series of support backings are connected between the spaced apart studs. Each support backing includes an elongated main section and a first tab formed on one end of the main section and extending at an angle with respect to the main section. A corner is formed between the main section and the first tab and one or more openings are formed in the corner. One or more tabs project from the other end of the main section. To secure the support backings within the wall structure, fasteners are utilized to secure the first tab of the support backings to the webs of the studs. Furthermore, the second tabs of the respective support backings project through the openings formed in the corner.

22 Claims, 5 Drawing Sheets

SUPPORT BACKING FOR WALL STRUCTURE

FIELD OF THE INVENTION

The present invention relates to wall structures, and more particularly to a wall structure having a series of support backings interconnected between consecutive studs for supporting structures such as hand rails, bumpers, cabinets, etc.

BACKGROUND

In the past, buildings have been typically constructed of wood. For example, wall structures were constructed with wooden studs, wooden sill and plate components as well as wooden headers. In recent years, more and more components of buildings have been constructed of metal. In particular, there is extensive use of metal studs today, especially in commercial buildings that include multi-floors. There are many advantages to metal studs as they are stronger and not subject to damage by pests such as termites, and are resistant to fire as well as being reasonably economical.

In certain instances, the metal studs in a building require a backing structure to extend between the studs to provide structural support for structures that are secured or hung to a wall. For example, structure backings should be provided between consecutive studs to provide structural stability for the installation of hand rails and cabinets.

Backing devices to support hand rails, cabinets, etc. are known. However, in general, backing devices of the prior art have not been convenient to install, but rather, are typically time consuming and even difficult to install properly. In addition, some backing devices used in wall structures do not lend themselves to being properly integrated into the wall structure, and more particularly, properly coupled to the spaced apart studs disposed in the wall structure. When backing devices are not securely coupled to the studs, there is likelihood, or at least a concern, that they will fail to transfer the vertical loads of objects, such as cabinets, to the studs in the wall.

Therefore, there has been and continues to be a need for a practical, cost effective backing device or backing support that can be easily and conveniently installed in a wall structure, and which effectively transfers loads from hand rails, cabinets and other objects to the studs within the wall structure.

SUMMARY

The present invention entails a support backing for incorporation into a wall structure for at least partially supporting an object, such as a handrail or a cabinet, connected to the wall structure. The support backing includes a main section. A first tab is disposed or formed on a first end portion of the main section and extends at an angle with respect to the main section. A corner formed between the main section and the first tab includes one or more openings. One or more second tabs are formed on a second end portion of the main section. When installed in a wall structure, the one or more second tab of one support backing is inserted into the openings in the corner of another support backing and the first tab of the one support backing is secured to a stud.

The present invention also includes a wall structure having a series of spaced apart studs with each stud including a web and a pair of flanges. Secured within the wall structure is a series of reinforcing members with the reinforcing members being connected between the spaced apart studs. Each reinforcing member includes a main section and a first tab formed on a first end portion of the main section and extending at an angle with respect to the main section. A corner is formed between the main section and the first tab. One or more openings is formed in the corner and one or more second tabs are formed on a second end portion of the main section. A series of fasteners is provided for connecting the first tab of each reinforcing member to a web of a stud. In addition, the one or more second tabs of each reinforcing member extend through the one or more openings formed in the corner of an adjacent reinforcing member. Hence, the reinforcing members are connected between respective studs of the wall structure.

Furthermore, the present invention entails a method of forming a wall structure. This method includes installing a series of studs in spaced apart relationship and connecting a series of support backings between the spaced apart studs. In connecting these support backings between respective studs, one or more second tabs associated with each support backing is inserted into openings formed in the corner of another support backing while a first tab associated with the one support backing is secured to a stud of the wall structure.

Other objects and advantages of the present invention will become apparent and obvious from a study of the following description and the accompanying drawings which are merely illustrative of such invention.

DETAILED DESCRIPTION

With further reference to the drawings, a support backing is shown therein and indicated generally by the numeral 10. The term "support backing" means a structure that forms a part of a wall structure and has secured thereto objects such as cabinets and handrails, and which at least partially supports such objects. In the embodiment disclosed, support backing 10 is constructed of metal and adapted to be integrated into a wall structure. When integrated into a wall structure, the support backing 10 serves as a support structure for attaching handrails, bumpers, cabinets, etc. to the wall structure.

Figure 1:
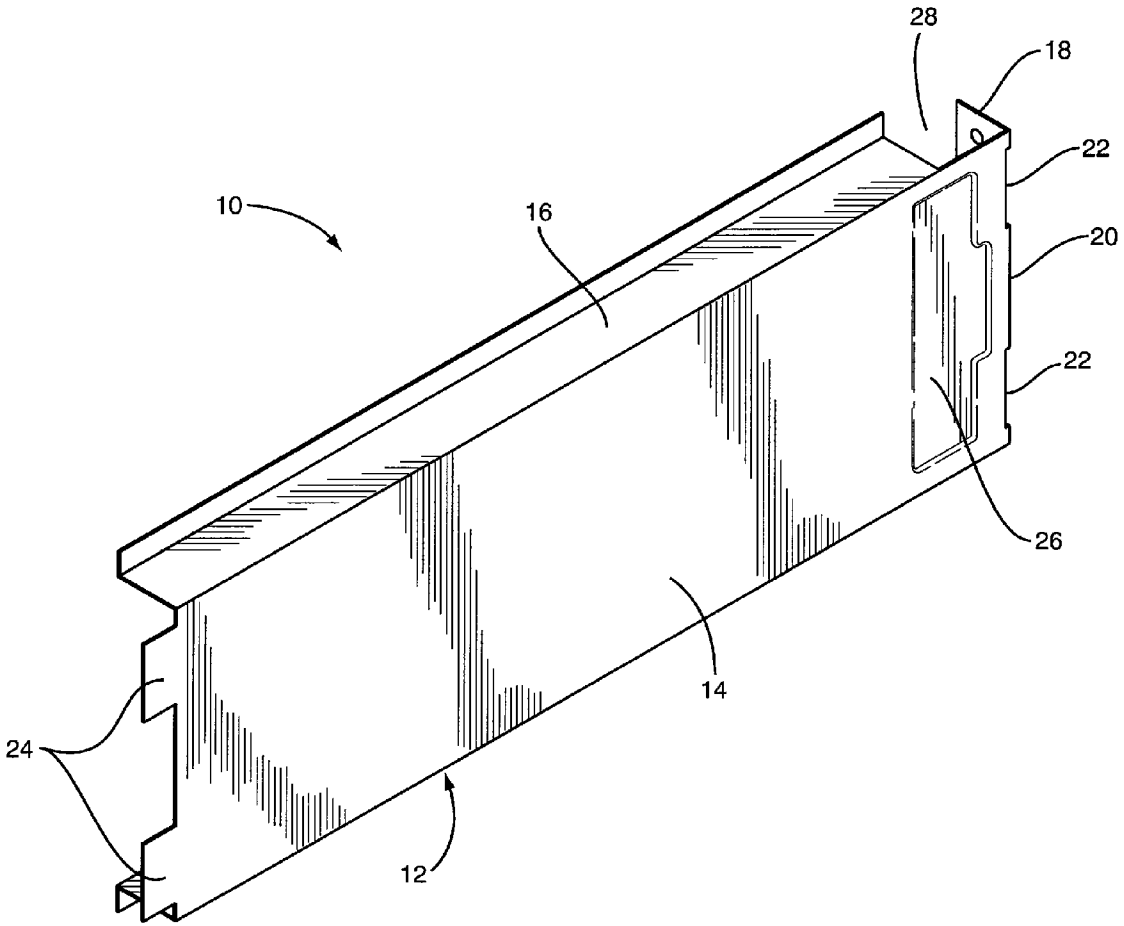
FIG. 1 is a perspective view of the support backing of the present invention.

With particular reference to FIG. 1, the support backing 10 is shown therein and includes a main section indicated generally by the numeral 12. Main section 12 includes elongated face plate 14. Extending from opposite edges of the face plate 14 is a pair of flanges 16.

Formed on one end of the main section 12 is a first tab 18. Tab 18 is bent or turned at an angle of approximately 90° with respect to the face plate 14. Openings are provided in the first tab 18 to permit the first tab to be secured to a portion of a wall structure.

By turning the first tab 18 at an angle, a corner 20 is formed between the first tab 18 and the face plate 14. Provided in corner 20 is a pair of openings 22. Openings 22, in the case of this embodiment, comprise slots or slits that are formed in the juncture or juncture area between the first tab 18 and the face plate 14. In this embodiment there is provided two openings 22. However, it will be appreciated by those skilled in the art that the number of openings 22 can vary.

Formed on the end of main section 12 opposite the first tab 18 is a pair of second tabs 24. Each of the second tabs 24 project in spaced apart relationship from the face plate. In the case of this embodiment, the second tabs 24 are sized and spaced so as to be insertable into and through the openings 22 formed in the corner 20 of another support backing 10. The significance of the corner 20 and its openings 22 and the tabs 24 will become more apparent in subsequent portions of this disclosure where the support backing 10 is discussed in relationship to a wall structure.

To impart strength to the main section 12, a rib 26 is formed in the face plate 14 adjacent the end portion of the main section having the corner 20. As seen in the drawings, the rib 26 is formed by forming a depression in the face plate 14 and is positioned closely adjacent the corner 20. Rib 26 reinforces the main section 12 and particularly the area of the face plate 14 adjacent the corner 20.

Figure 3:
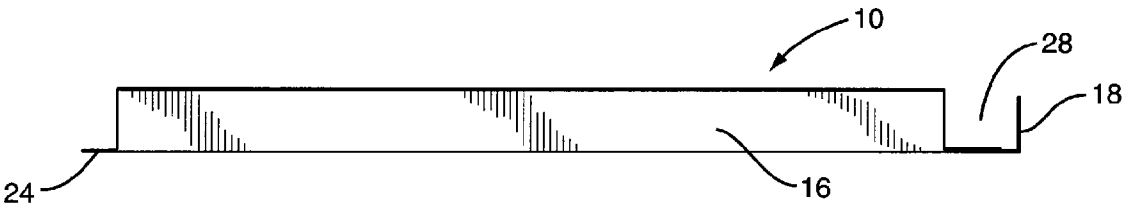
FIG. 3 is a top plan view of the support backing.
Figure 2:
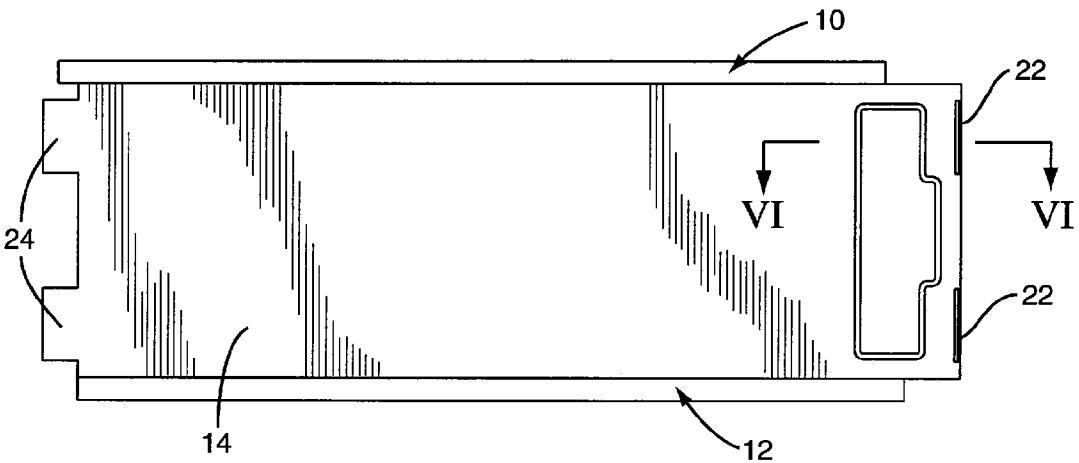
FIG. 2 is a side elevational view of the support backing.
Figure 5:
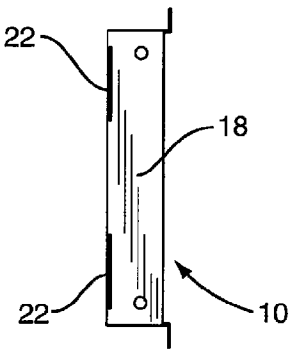
FIG. 5 is an elevational view of the other end of the support backing.
Figure 4:
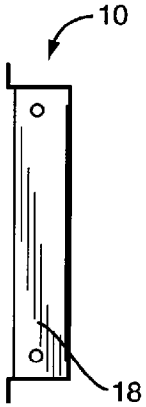
FIG. 4 is an elevational view of one end of the support backing.
Figure 6:
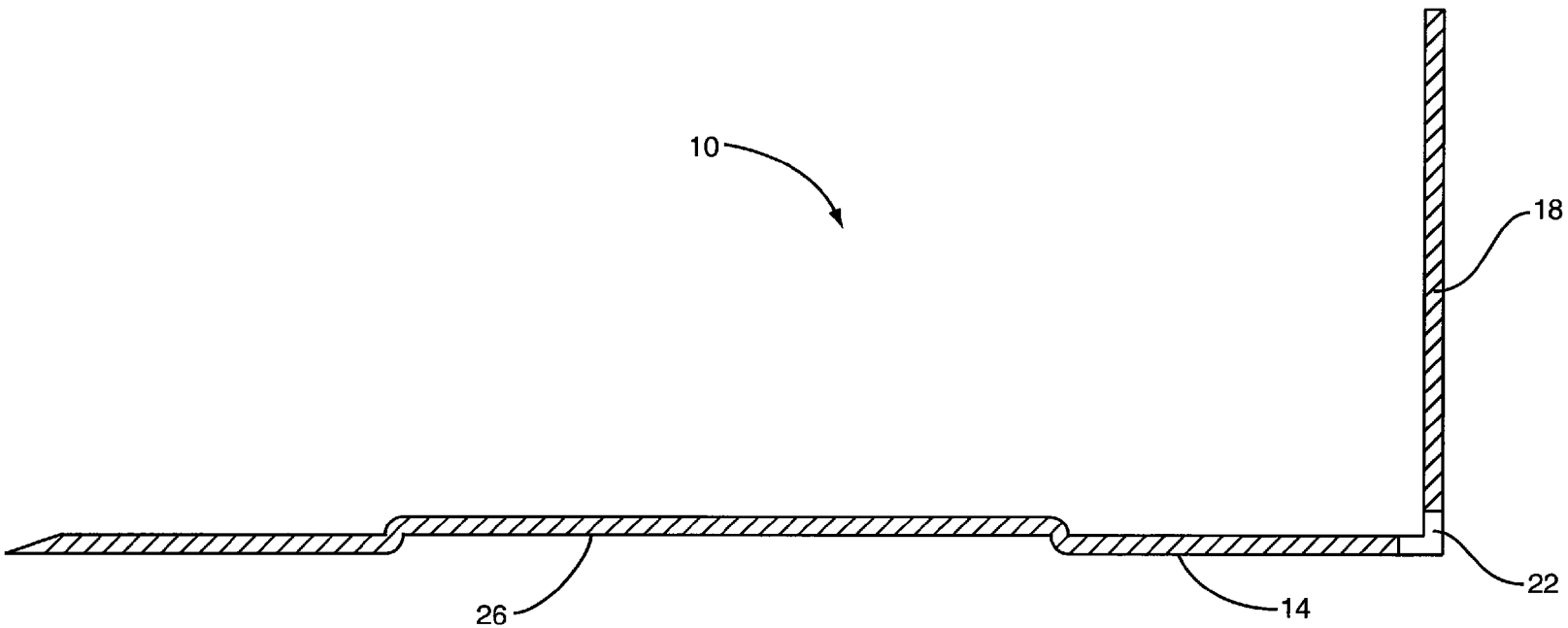
FIG. 6 is a fragmentary sectional view taken through the line VI-VI of FIG. 2.

As seen in FIGS. 1 and 3, the flanges 16 extending from the face plate 14 terminate short of the first tab 18. That is, the flanges 16 terminate in spaced apart relationship to the first tab 18. Hence, a stud slot 28 is formed by the first tab 18, the adjacent back surface of the face plate 14 and the edges of the flanges 16. The term "stud slot" means an opening through which at least a part of a stud extends. This stud slot 28 enables a portion of a stud to project therethrough when the support backing 10 is secured within a stud wall.

Figure 7:
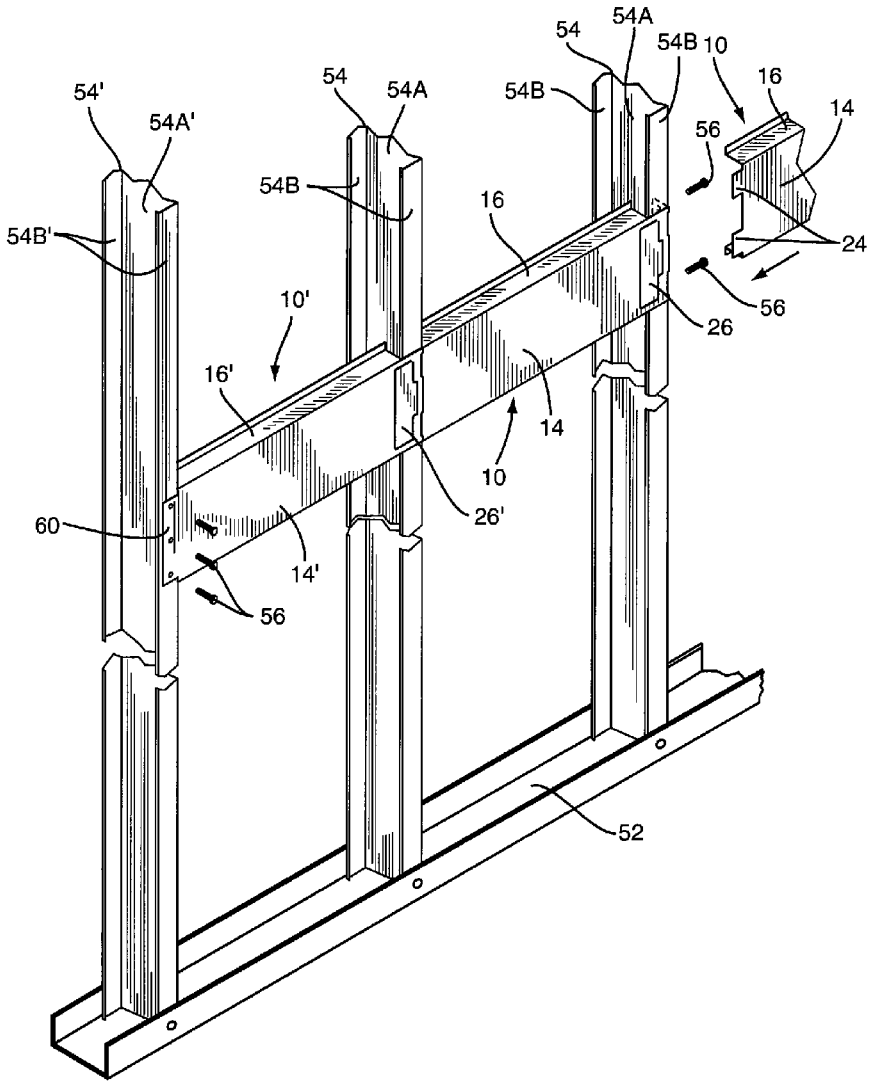
FIG. 7 is a fragmentary perspective view of a wall structure having a series of support backings incorporated therein.
Figure 8:
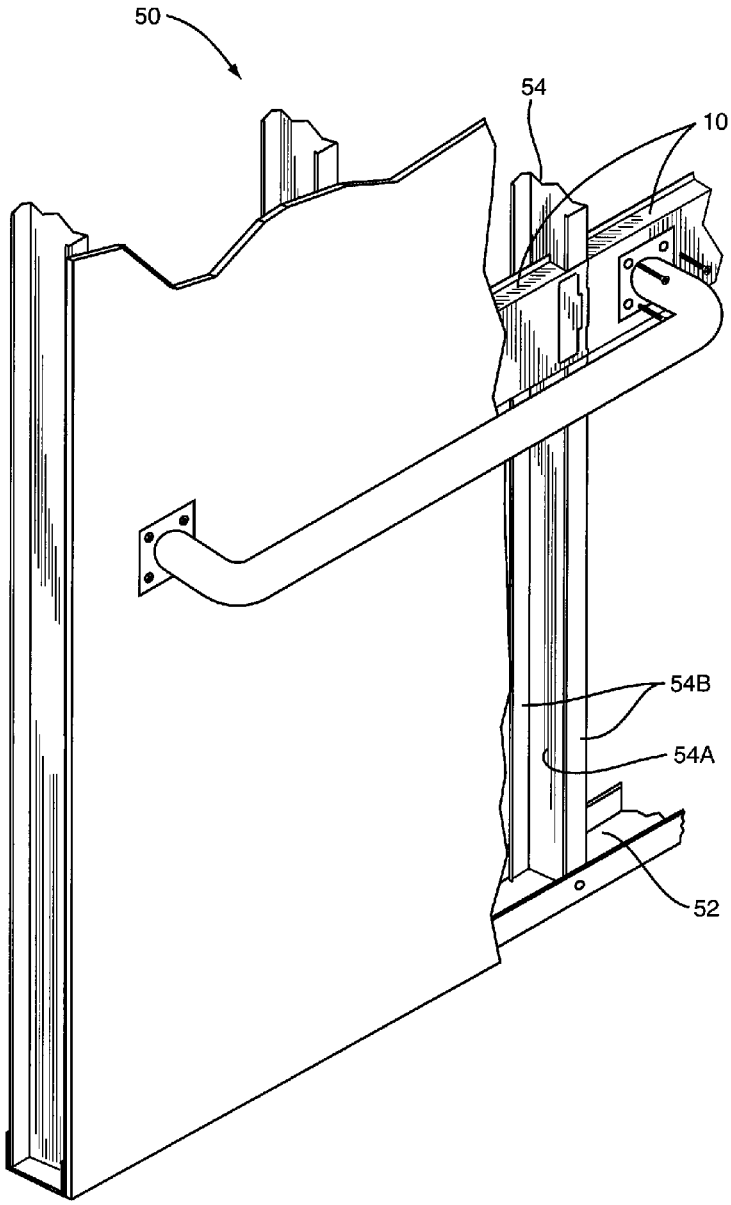
FIG. 8 is a fragmentary perspective view of a wall structure having the support backings incorporated therein, and at least partially supporting a handrail.

Turning to FIGS. 7 and 8, a wall structure is shown therein and indicated generally by the numeral 50. Wall structure 50 includes a lower track 52 that is adapted to be secured to a support structure such as a concrete floor. Extending upwardly from the lower track 52 and in spaced apart relationship is a series of studs 54. In this embodiment, studs 54 are metal studs. Each stud 54 includes a web 54A and a pair of flanges 54B. It is understood and appreciated, however, that the support backing 10 could be utilized with studs constructed of other material, such as wood studs.

A series of support backings 10 are integrated or connected into the wall structure 50. In particular and in this embodiment, the support backings 10 are secured in end-to-end fashion along one side of the studs 54. In each case, the second tabs 24 are inserted into the openings 22 formed in the corner of an adjacent support backing 10. The opposite end of the support backing 10 is disposed such that a portion of a stud 54 projects through the stud slot 28. Hence, it is appreciated that the first tab 18 extends around a portion of the stud 54 and the first tab is secured to the web 54A of the stud by utilizing a series of fasteners 56 that are extended through predrilled openings in the first tab. Hence, as viewed in FIG. 7, the end of the main section 12 having the first tab 18 is securely connected to one stud while the other end of the main section 12 is supported by virtue of the second tabs 24 extending through the corner openings 22 of an adjacent support backing 10.

To install a series of support backings 10 into the wall structure 50, a first support backing 10' is secured to a first stud, which is indicated in FIG. 7 by the numeral 54'. In many cases, the first stud 54' is spaced from the next adjacent stud a distance less than a standard spacing. For example, in many cases the studs will be spaced 16" on center. If the spacing between the first stud 54' and the next adjacent stud is less than 16", then the first support backing 10 may be trimmed and altered. In the case illustrated in FIG. 7, the end portion of the support backing 10' having the second tabs 24 is altered and cut to a selected distance, and end tab 60 is formed about the end of the support backing 10' opposite the tab 18'. End tab 60 is secured to the flange 54B' of the first stud 54' by a series of fasteners 56. After the end tab 60 has been secured to the stud 54', then the opposite end of the support backing 10' can be secured to the next adjacent stud in the manner described above. That is, the first tab 18 of the same support backing 10' is secured to the web 54A of the next stud.

In the wall structure 50 shown in FIGS. 7 and 8, the support backings 10 are secured one at a time from left to right. After the first support backing 10' has been installed, as just described, the next support backing 10 is installed by inserting the second tabs 24 into the openings 22 formed in the corner 20 of the previously installed support backing 10'. Stiffening ribs 26 abut against flange 54B of a stud and this causes face plate 14 to stand out from the stud surface by the thickness of the tabs 24. This facilitates the insertion of the tabs 24 into openings 27. To further facilitate the ease of installation, it may be desirable to secure the first tab 18 to a web 54A such that there is a slight spacing between the adjacent flange 54B and the back surface of the face plate 14 disposed directly adjacent that same flange 54B. When inserted through the openings 22, the tabs 24 will lie between the outer surface of flange 54B and the adjacent inner surface of the face plate 14. In the course of installing consecutive support backings 10, it may be beneficial to insert the tabs 24 at a slight angle to the face plate 14 or opening 22 formed in the corner 20 of a particular support backing 10. As the tabs 24 are inserted at a slight angle and pushed through the openings 22, an installer may, in the process, swing the support backing 10 being installed towards an aligned position with the preceding or leftmost support backing 10 shown in FIG. 7. In the process, tabs 24 will be pushed through the openings 22 and the opposed end will be swung into an aligned position where the adjacent stud 54 will fit into or partially seat into the stud slot 28. Now the first tab 18 can be secured to the web 54A of the stud 54. This process is continued, one support backing 10 at a time, until the entire wall structure 50 includes support backings 10 extending between consecutive studs 54. As the installation proceeds left to right as viewed in FIG. 7, it is possible that the last stud 54 may be spaced less than a standard spacing from the preceding stud. In this case, similar to the first stud 54' shown in FIG. 7, the support backing 10 can be modified about the rightmost end portion to include an end tab 60 that can be secured to the flange of an end stud.

In the embodiment illustrated, it is seen that the support backings 10 are horizontally aligned. However, it should be appreciated that in the case of a staircase, for example, the respective support backings 10 in a wall structure could be stepped such that a banister or supports associated with a handrail could be secured thereto. Note when incorporated into the wall structure 50 that the face plates are generally aligned with the adjacent flanges 54B of the studs 54. In the embodiment illustrated herein, the face plates 14 are not exactly or precisely aligned with the flanges 54B because the face plates lie just outwardly of the flanges 54B. However, in any event, the face plates 14 are disposed along one side of the studs and the respective flanges 16 of the support backings 10 project inwardly past the adjacent flanges 54B.

The support backings 10 have substantial utility in various types of wall structures. For example, the support backings 10 provide a surface so that handrails, bumpers, cabinets, etc. can be mounted to the wall surface without pulling out.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A wall structure comprising:

a. a series of spaced apart studs with each stud including a web and a pair of flanges;

b. a series of support backings connected between the spaced apart studs;

c. each support backing comprising:

i. a main section having a face plate;

ii. a first tab formed on a first end portion of the main section and extending at an angle with respect to the main section;

iii. a corner formed between the main section and the first tab and including a corner edge formed at the intersection of the first tab and the main section;

iv. one or more openings formed in the corner edge;

v. one or more second tabs formed on a second end portion of the main section; and vi. the one or more second tabs projecting outwardly from the face plate such that the one or more second tabs extend generally parallel to the face plate;

d. fasteners connecting the first tab of each support backing to a web of one stud; and e. the one or more second tabs of each support backing projecting through the one or more openings and sandwiched between one flange of one of the studs and the face plate.

2. The wall structure of claim 1 wherein the support backings include stiffening ribs.

3. The wall structure of claim 2 wherein the ribs are disposed adjacent the corners of the support backings.

4. The wall structure of claim 3 wherein the ribs are formed by depressions in the main sections of the support backings.

5. The wall structure of claim 1 wherein the angle formed by the first tab and the main section is an angle of about 90°.

6. The wall structure of claim 1 wherein the main section of each support backing includes the face plate and a pair of flanges and wherein there is defined a slot between the first tab and the flanges of each support backing; and wherein at least a portion of each stud extends through into the slot of each support backing.

7. The wall structure of claim 6 wherein a portion of the web and a portion of the flanges of each stud project into the slot of each support backing.

8. The wall structure of claim 1 wherein the corner edges include two openings and each support backing includes a pair of second tabs, and wherein the pair of second tabs of each support backing project through the openings formed in the corner edges of an adjacent support backing.

9. The wall structure of claim 1 wherein each support backing includes a banister backing and wherein the wall structure includes is a series of handrail supports secured to the banister backings.

10. The wall structure of claim 9 including an interior wall surface secured to the studs and wherein the series of handrail supports extend from the interior wall surface and are secured to the banister backings.

11. The wall structure of claim 1 including a depression formed in the face plate adjacent a corner edge, and where the depression is located on the face plate to engage one of the studs and cause the face plate to be spaced outwardly from the stud and form a gap between the face plate and the stud to enable the one or more second tabs to be inserted between the face plate and the stud.

12. The wall structure of claim 11 wherein the one or more openings formed in the corner edge extend into both the face plate and the first tab.

13. The wall structure of claim 1 wherein the one or more second tabs include two spaced apart tabs that project from an edge of the face plate and wherein the two second tabs extend in a plane-coplanar with the face plate.

14. A wall structure comprising:

a. a series of spaced apart studs with each stud including a web and a pair of flanges;

b. a series of reinforcing members connected between the spaced apart studs;

c. each reinforcing member including:

i. a main section having a face plate, a depression formed in the face plate adjacent the corner, and where the depression is located on the face plate to engage one of the studs and cause the face plate to be spaced outwardly from the stud and form a gap between the face plate and the stud to enable the two second tabs to be inserted into the openings formed in the corner and between the face plate and the stud;

ii. a first tab formed on a first end portion of the main section and extending at an angle with respect to the main section;

iii. a corner formed between the main section and the first tab;

iv. one or more openings formed in the corner;

v. wherein the one or more openings formed in the corner extend into both the first tab and the face plate; and vi. one or more second tabs formed on a second end portion of the main section;

d. the face plates extending along one side of the studs;

e. fasteners connecting the first tab of each reinforcing member to a web of one stud; and f. the one or more second tabs of each reinforcing member projecting through the one or more openings formed in the corner of an adjacent reinforcing member.

15. The wall structure of claim 14 wherein the face plates are disposed outwardly of the studs.

16. The wall structure of claim 14 wherein the face plates of the reinforcing members are generally aligned with the flanges disposed on one side of the studs.

17. The wall structure of claim 14 wherein the reinforcing members include opposed flanges that project into the plane of the studs.

18. The wall structure of claim 17 wherein each reinforcing member includes a slot formed by the flanges of the reinforcing member and the first tab and wherein at least a portion of a stud projects through the slot.

19. A wall structure, comprising:

(a) a series of spaced apart studs;

(b) a series of support backings connected to the studs and extending between the studs;

(c) each support backing including:

(i) a main section having a face plate;

(ii) a first tab formed on a first end portion of the main section and extending at an angle with respect to the main section;

(iii) a corner formed between the main section and the first tab;

(iv) one or more openings formed in the corner;

(v) one or more second tabs formed on a second end portion of the main section;

(vi) a depression formed in the face plate adjacent the corner, the depression particularly spaced and located on the face plate for abutting against one of the studs of the wall structure;

(d) wherein the depressions abutting against the stud cause adjacent portions of the face plate located between the depressions and the corners to be spaced outwardly from the stud so as to define gaps between the face plate and the studs adjacent the respective corners of the main sections; and (e) wherein the one or more second tabs project into the one or more openings in the corners of adjacent support backings and into the gaps defined between respective studs and the face plates such that the one or more second tabs are disposed in the gaps and are sandwiched between the face plates and the studs.

20. The wall structure of claim 19 wherein each main section includes a pair of opposing flanges.

21. The wall structure of claim 20 wherein each support backing includes a slot formed between the opposing flanges of the main section and the first tab.

22. The wall structure of claim 19 wherein the corner is defined by an edge and wherein the one or more openings formed in the corner are formed in the edge and wherein the one or more openings extend into the face plate and the first tab.

* * * * *